US005758243A

United States Patent [19]

Haneda et al.

[11] Patent Number: 5,758,243

[45] Date of Patent: May 26, 1998

[54] COLOR IMAGE FORMING APPARATUS

[75] Inventors: Satoshi Haneda; Hisayoshi Nagase; Hiroyuki Tokimatsu; Masahiro Onodera; Shuta Hamada, all of Hachioji; Toshihide Miura, Koganei, all of Japan

[73] Assignee: Konica Corporation, Tokyo, Japan

[21] Appl. No.: 798,485

[22] Filed: Feb. 10, 1997

[30] Foreign Application Priority Data

Feb. 13, 1996 [JP] Japan ..... 8-025285

[51] Int. Cl.[6] ..... G03G 21/00

[52] U.S. Cl. ..... 399/298; 399/111; 399/117

[58] Field of Search ..... 399/298, 107, 399/111, 112, 117, 411, 116

[56] References Cited

U.S. PATENT DOCUMENTS

| | | | |
|---|---|---|---|
| 5,053,821 | 10/1991 | Kunugi et al. . | |
| 5,065,183 | 11/1991 | Morofuji et al. . | |
| 5,504,564 | 4/1996 | Snelling et al. . | |
| 5,557,377 | 9/1996 | Loewen et al. . | |
| 5,557,394 | 9/1996 | Haneda et al. . | |
| 5,581,291 | 12/1996 | Nishiguchi et al. | 347/129 |
| 5,600,408 | 2/1997 | Horiuchi et al. | 399/39 |
| 5,608,497 | 3/1997 | Haneda et al. | 399/153 |
| 5,608,498 | 3/1997 | Nagase et al. | 399/130 |
| 5,615,002 | 3/1997 | Haneda et al. | 399/227 |
| 5,640,652 | 6/1997 | Nagase et al. | 399/167 |
| 5,663,787 | 9/1997 | Haneda et al. | 399/111 |
| 5,666,605 | 9/1997 | Tokimatsu et al. | 399/173 |

*Primary Examiner*—R. L. Moses

*Attorney, Agent, or Firm*—Frishauf, Holtz, Goodman, Langer & Chick

[57] ABSTRACT

An image forming apparatus includes a rotary image forming body; a charger provided around the image forming body for charging the image forming body; a plurality of imagewise exposure devices for imagewise exposing the charged image forming body to form respective latent images thereon; and a plurality of developing devices for developing the respective latent images formed on the image forming body to form respective toner images. A plurality of different color toner images thus formed by the respective chargers, the respective imagewise exposure devices and the respective developing devices are superimposed on the image forming body, thereby a color toner image is formed. The image forming apparatus further includes a transfer device for transferring the color toner image on the image forming body onto a transfer member; a cleaning device for removing a residual toner on the image forming body; a support member for supporting the plurality of exposure devices. The support member and plurality of exposure devices supported on the support member are provided inside the image forming body kept in a static status. The image forming apparatus is further provided with a gap keeping member for holding the chargers, the developing devices, the transfer device or the cleaning device with positional reference to the support member so as to keep a gap with the image forming body constant.

4 Claims, 3 Drawing Sheets

COLOR IMAGE FORMING APPARATUS

BACKGROUND OF THE INVENTION

The present invention relates to a color image forming apparatus for use in copiers, printers or facsimiles, and specifically relates to an electrophoto type color image forming apparatus which locates plural chargers, image exposure means and developing devices and a transfer device and a cleaning device in the periphery of an image forming body and which forms a color image by superposing toner images during one rotation of the image forming body.

Conventionary, as a method of forming a multi-color image, one being a color image forming apparatus wherein image forming means, chargers and developing devices whose number are identical to that of colors necessary for color image forming and a color image is formed by superposing respective monochromatic toner images formed on the image forming body on a recording sheet by a transfer device, a color image forming apparatus wherein the image forming body is rotated plural times so that charging, image exposure and developing for each color are repeated for forming a full color image and a color image forming apparatus which successively conducts charging, image exposure and developing within one rotation of the image forming body for forming a color image are known.

However, among each of the above-mentioned image forming apparatus, a color image forming apparatus wherein image exposing means, chargers and developing devices whose number are identical to the number of colors necessary for a color image forming are provided and the color image is formed by superposing respective monochromatic toner images formed on the respective image forming bodies on a recording sheet by a transfer device has the shortcoming to expand the volume of the apparatus since it is necessary to convey plural image forming bodies and recording sheets. On the other hand, in the case of a color image forming apparatus wherein the image forming body is rotated for plural times so that charging, image exposure and developing for each color are repeated for forming a color image has the restriction that the dimensions of the image formed is limited to not larger than the surface area of the photoreceptor though there is a merit that the volume of the apparatus is downsized.

In this meaning, a color image forming apparatus which successively conducts charging, image exposure and developing within a single rotation of the image forming body for forming a color image has the merit that high speed image formation can be attained while there is no practical limit to the dimensions of the image.

In the above-mentioned color image forming apparatus, numerous image forming means such as plural image exposure means, chargers and developing devices and transfer device and cleaning device are located around the image forming body. In order to maintain the gap between the image forming means which are provided to face the image forming body and aforesaid image forming body, for example, in the developing device, a pressure roller is used as a gap retention member mounted in aforesaid developing device, and aforesaid roller is pressed against the end of image forming body. Or, a roller or a sliding member used as a gap retention member provided on the end of the transfer device is pressed against the image forming body for maintaining the required gap.

However, if the gap retention member of the image forming means such as chargers, developing devices, transfer device and cleaning device are pressed against the image forming body so as to retain the gap with the image forming body, the image forming body is pressed on the gap retention member provided on the image forming means and the image forming body is deformed or damaged, preventing formation of favorable images.

In addition, due to decentering, vibration of the rotating drum (the image forming body) causes unfavorable influence on the image forming means. Therefore, there is concern that favorable images cannot be formed.

SUMMARY OF THE INVENTION

An object of the present invention is to solve the above-mentioned problems and to provide a color image forming apparatus wherein the gap between the image forming body and the image forming means in which the image forming body is neither deformed nor damaged while keeping favorable image formation.

The objects of the present invention is attained by the following image forming apparatus:

- rotating image forming body;
- chargers which are located in the periphery of the image forming body and which charge the image forming body;
- plural image exposure means which expose the charged image forming body and which form latent images;
- plural developing devices which develops the latent images formed on the image forming body and which form toner images, wherein a color toner image is formed by superposing plural toner images having different colors each other on the image forming body;
- transfer means which transfers the color toner image onto a recording sheet from the image forming body;
- cleaning means which removes residual toner on the image forming body;
- supporting member which supports the plural image exposure means, wherein the supporting member is located inside the image forming body together with plural image exposure means; and
- gap retention member which retains the above-mentioned developing device, chargers, transfer means or cleaning means with positional reference to the above-mentioned supporting member so as to keep the gap with the image forming body constant.

DETAILED DESCRIPTION OF THE PREFERRED EMBODIMENT

Figure 1:
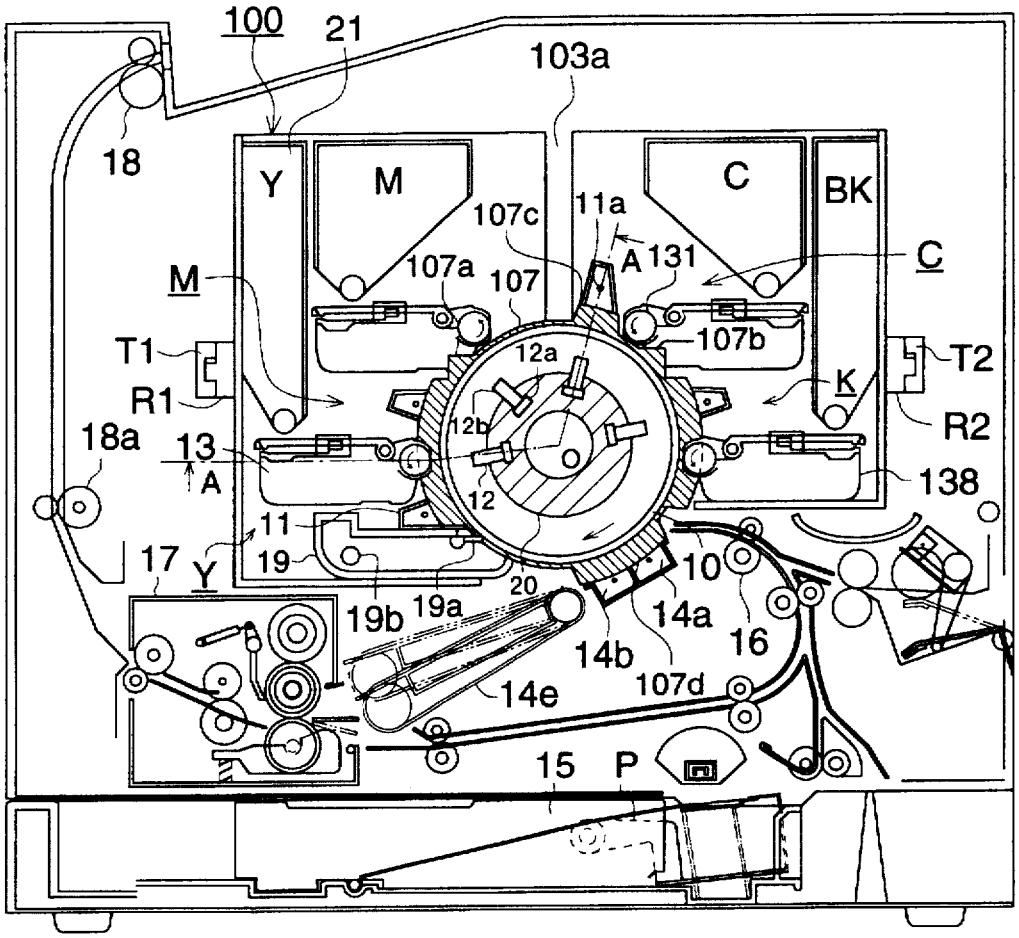
FIG. 1 is a cross sectional view of one embodiment of a color image forming apparatus of the present invention.
Figure 2:
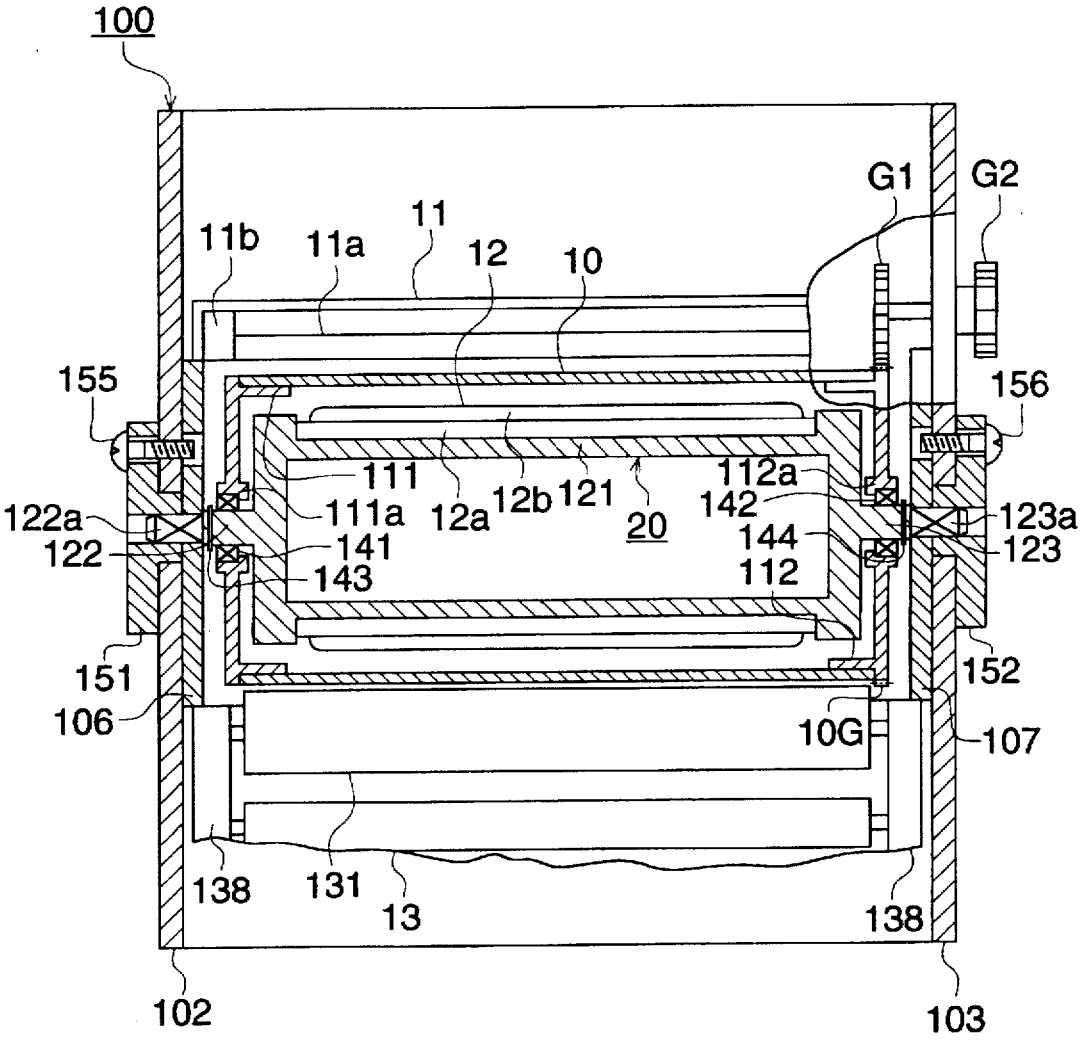
FIG. 2 is a side cross sectional view of plane A-O-A in FIG. 1.
Figure 3:
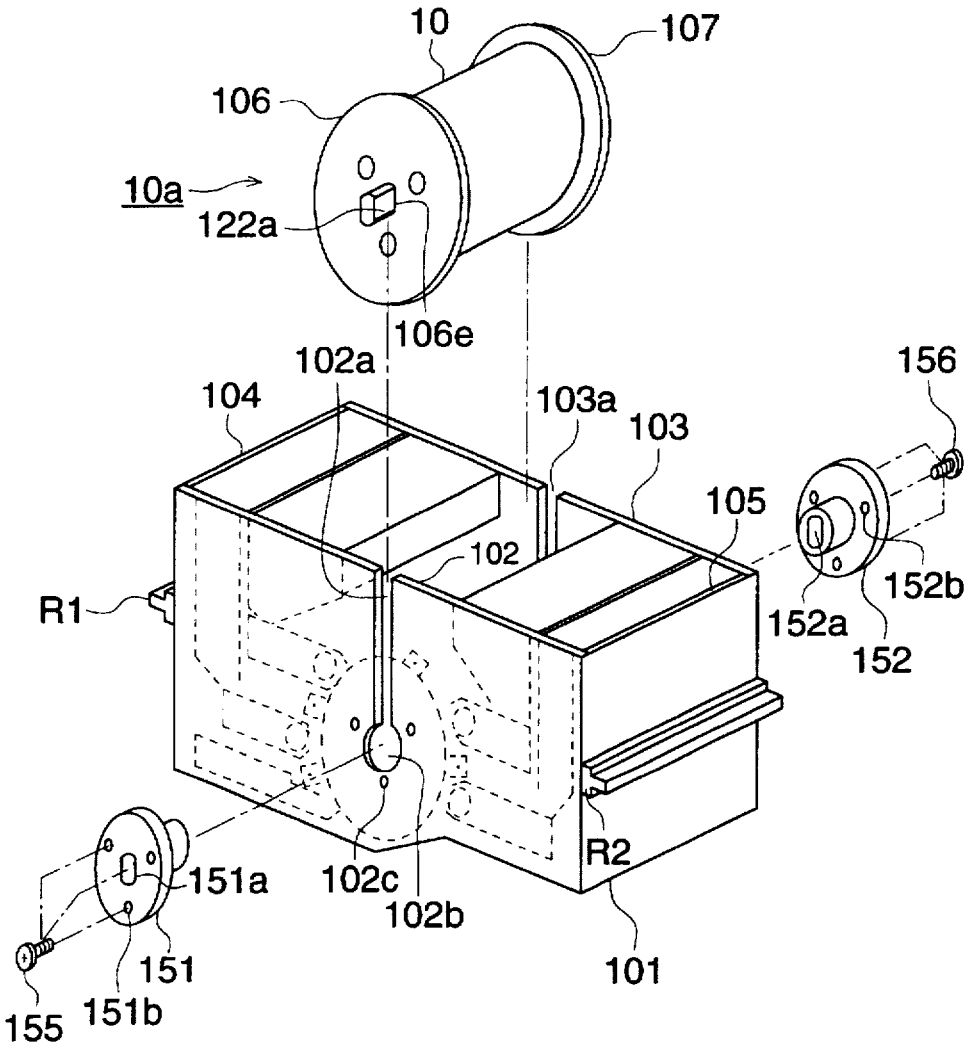
FIG. 3 is an assembly drawing of the process unit.

An image forming process and each mechanism of one embodiment of a color image forming apparatus of the present invention will be explained referring to FIGS. 1 through 3. FIG. 1 is a cross sectional view of one embodiment of a color image forming apparatus of the present invention. FIG. 2 is a side cross sectional view of plan A-O-A in FIG. 1. FIG. 3 is an assembly view of a process unit.

The structure of a color image forming apparatus of the present embodiment is as follows. Namely, as an image forming body, a photoreceptor drum, provided with a conductive layer and a photoreceptor layer on the circumference of a transparent substrate is used. Inside the photoreceptor, an image exposure means is provided. Around the photoreceptor, image forming and processing means such as chargers, developing devices, a transfer device, a neutralizer and a cleaning device are located.

Inside photoreceptor drum 10, which is an image forming body, a cylindrical substrate formed by a transparent member made of transparent acrylic resin is provided. On the circumference of photoreceptor drum 10, photosensitive layers, including a transparent conductive layer, an a-Si layer or an organic photosensitive layer (OPC), are formed. The photoreceptor drum 10 is rotated clockwise as shown by an arrow in FIG. 1 while it is grounded.

The color image forming apparatus may have an exposure amount capable of providing a suitable contrast in a photoconductive material layer on the photoreceptor drum. Accordingly, the light transmissive ratio of the transparent substrate of the photoreceptor drum in the present embodiment is not necessarily 100%. The color image forming apparatus may also have a property in which exposure beams may be absorbed to some extent when the exposure beam transmits through the transparent substrate. In addition, "transparent" is defined to be transmissivity of image exposure light beams. "Transparent" includes cases when the substrate is colored. As a material of a transparent substrate, an acrylic resin-polymerized material, specifically, metacrylic acid methylester monomer-polymerized materials are so excellent in terms of transparency, strength, accuracy and surface properties as to be preferably used. In addition, various translucent resins such as acrylic, fluorine, polyester, polycarbonate and polyethylene terephthalate which are used in ordinary optical members are usable. As a translucent conductive layer, indium, tin, oxidized products (ITOs), tin oxide, indium oxide and copper iodide and metallic thin layers composed of Au, Ag, Ni and Al and maintaining translucency are usable. As a layer forming method, a vacuum deposition method, an active reaction deposition method, any spattering method, any CVD method, dip coating methods and spray coating methods may also be utilized. In addition, as a photoconductive material layer, an amorphous silicone (a-Si) alloy photosensitive layer, an amorphous selenium alloy photosensitive layer and each organic photosensitive layer (OPC) are usable.

Scorotron chargers 11, which are used as scorotron charging devices, are used for an image forming process for each of yellow (Y), magenta (M), cyan (C) and black (K) colors. They are mounted facing the photoreceptor drum 10 in a direction perpendicular to the moving direction of photoreceptor drum 10. As a control grid and corona discharging electrode ila in which potential is kept at a prescribed level compared to the above-mentioned organic photoreceptor layer in photoreceptor drum 10, the scorotron charger effects charging by means of corona discharge employing a wire electrode and a saw-toothed electrode for providing uniform potential on photoreceptor drum 10.

Exposure unit 12 as an image exposure means for each color is located in such a manner that the exposure position on photoreceptor drum 10 is between corona discharging electrode 11*a* in scorotron charger 11 and the developing position in developing device 13 and that it is upstream side of a rotation direction of the photoreceptor 10 relating to development sleeve 131.

Exposure unit 12 is composed of bar-shaped exposure element 12*a* wherein plural LEDs (light emission diode), as light emission elements parallel to the shaft of photoreceptor drum 10 and in the primary scanning direction, are arranged in an array form and a Selfoc lens 12*b*, as a life size image-formation element. Aforesaid exposure element 12*a* and the Selfoc lens 12*b* are mounted on a holder (not illustrated). Aforesaid exposure unit 12 is mounted on supporting member 20 which retains exposure unit 12 provided inside of photoreceptor drum 10. Image data of each color, stored in the memory, is successively read from the memory and are inputted into exposure unit 12 for each color as electrical signals.

In addition, as an exposure element, a bar-shaped one wherein plural light emission elements such as FLs (fluorescent light emission), an EL (electroluminescence), PLs (plasma discharge) and LEDs (light emission diode) are arranged in an array mode. The light emission wavelength of the light emission element used in the present embodiment is preferably in a range between 680 and 900 nm which has a high transmissive rate to Y, M and C toner. However, since images are exposed from the rear surface, a wavelength, shorter than the above-mentioned value, which does not have sufficient transparency to color toner may be used.

Next, order of color wherein images are formed and the type of developing devices provided in accordance with aforesaid color order in the present embodiment will be explained. In the present invention, photoreceptor drum 10 rotates in an arrowed direction as shown in FIG. 1. Y and M developing devices 13 are located at the left of photoreceptor drum 10. C and K developing devices are located to the right of photoreceptor drum 10. Y and M scorotron chargers 11 are located respectively below development casing 138 of Y and M developing devices 13. C and K scorotron chargers 11 are located respectively above development casing 138 of C and K developing devices 13. As described later, both ends of an image forming means such as scorotron chargers 11, developing devices 13 for each color, transfer device 14*a* and cleaning device 19 are brought into contact with gap retention members 107 and 106 (not illustrated) provided in front of and at the back of photoreceptor 10 so that the gap with photoreceptor drum 10 is retained.

Each of the four developing devices 13, which is a developing means for each color, respectively houses a one-component or two-component yellow (Y), magenta (M), cyan (C) or black (K) developer. The developing devices maintains a prescribed gap with the circumference of photoreceptor 10, and are provided with development sleeves 131 which rotate in the same direction as the rotation direction of photoreceptor drum 10 at developing position.

The developing devices for each color reversely develop electrostatic latent images on photoreceptor drum 10 formed due to charging by means of the scorotron chargers 11 and image exposure by means of exposure unit 12 under non-contact state by means of a non-contact development method due to applying the development bias voltage.

With regard to the original images, images read by an image sensor in an image reading device separately provided from the present apparatus or images edited by a computer are temporally stored in the memory as images for each of Y, M, C and K colors.

When starting image recording, a driving motor for the photoreceptor (not illustrated) is driven so that photoreceptor drum 10 is rotated clockwise as shown by an arrow in FIG. 1. Simultaneously, provision of potential onto photoreceptor drum 10 starts due to charging effect of Y scorotron charger 11 which is provided to the left of photoreceptor drum 10 and below development casing 138 of the yellow (Y) developing device 13.

After photoreceptor drum 10 is provided with potential, in Y exposure unit 12, exposure by means of an electrical signal which corresponds to the first color signal, i.e. Y image data starts. Due to the rotation and scanning of the drum, electrostatic latent image which corresponds to Y image of the original image are formed on the photosensitive layer on the surface of the drum.

The latent image is reversely developed by Y developing device 13 while the developer on development sleeve is in a non-contact state. In accordance with rotation of photoreceptor drum 10, yellow (Y) toner image is formed on photoreceptor drum 10.

Next, on the yellow (Y) toner image, photoreceptor drum 10 is provided with potential due to charging effect by magenta (M) scorotron charger 11 which is located to the left of photoreceptor drum 10 and below development casing 138 of magenta (M) developing device 13. Then, in M exposure unit 12, exposure by means of an electrical signal which corresponds to the second color signal, i.e., M image data starts. Magenta (M) toner image is successively superposed on the yellow (Y) toner image due to non-contact reversal development by means of M developing device 13.

Under the same process, cyan (C) toner image corresponding to the third color signal due to cyan scorotron charger 11 which is located to the right of photoreceptor drum 10 and above development casing 138 of development device 13, C exposure unit 12 and C developing device 13 and black (K) toner image corresponding to the fourth color signal due to black scorotron charger 11 which is located to the right of photoreceptor drum 10 and above development casing 138 of development device 13. K exposure unit 12 and K developing device 13 are successively superposed so that, as a result, a color toner image is formed on the circumference of photoreceptor drum 10 within one rotation of photoreceptor drum 10.

Organic photosensitive layer on photoreceptor drum 10 is exposed to light from inside the drum through the transparent substrate by means of Y, M, C and K exposure unit 12. Accordingly, image exposure corresponding to the second, third and fourth color signal receives no influence by the toner image superposed in advance so that electrostatic latent image equivalent to an image corresponding to the first color image can be formed.

In addition, developer for replenishing each color is replenished from replenishing tank to corresponding developing device 13. Development casing 138 is pressed against gap retention members 107 and 106 which are located forward and backward of photoreceptor drum 10. Photoreceptor drum 10 and development sleeve 131 are kept in non-contact at a prescribed gap, for example, 100–1000 μm. When conducting development by developing devices for each color, development bias of D.C. voltage or D.C. voltage in conjuction with A.C. voltage are applied to development sleeve 131. Jumping development by means of a one-component or two-component developer housed in a developing device is conducted. Onto photoreceptor drum 10 wherein a transparent conductive layer is grounded, D.C. bias having the same polarity as the toner is applied. Thus, non-contact reversal development wherein toner is adhered onto the exposed portion is conducted.

Recording sheet P, which is a transfer medium, is fed from paper feeding cassette 15 which is a recording sheet housing means, and conveyed to timing roller 16. Color toner image formed on the circumference of photoreceptor drum 10 is transferred at the transfer device **14*a* onto recording sheet P which is fed synchronously with the toner image on photoreceptor drum 10** by the drive of the timing roller.

Recording sheet P on which toner image has been transferred is subjected to neutralization at neutralizer **14*b*, and then is separated from the circumference of the drum. Following this, the recording sheet is conveyed to fixing device 17 by means of conveyance belt 14*e*, which is a conveyance means. At fixing device 17, the recording sheet is heated and pressed so that the toner is fused and fixed onto recording sheet P. Following this, the recording sheet is discharged from fixing device 17. The recording sheet is conveyed by means of paired paper-ejecting conveyance roller 18*a*** to be fed out on a tray located above the apparatus with the toner image surface facing downward.

With regard to photoreceptor drum 10 from which the recording sheet has been separated, the surface of photoreceptor drum 10 is scraped by cleaning blade **19*a* at cleaning device 19 so that residual toner was removed and the drum surface was cleaned. Following this, the formation of the toner image of the original image will be continued, or the formation temporarily stops, and then, the formation of the toner image of the next original image will be started. Waste toner scraped by cleaning blade 19*a* is fed to a waste toner container (not illustrated) by toner conveyance screw 19*b*. After the cleaning operation, in order to prevent damage to photoreceptor drum 10 by cleaning blade 19*a*, aforesaid cleaning blade is kept away from photoreceptor drum 10**.

Front side plate 102, rear side plate 103 and left and right side plates 104 and 105 are integrated into a unit to constitute frame 101 of process unit 100.

Supporting member 20 for the photoreceptor drum is composed of cylinder portion 121 and supporting shafts 122 and 123 on both ends. Exposure units 12 for each color are fixed on cylinder portion 121 of supporting member 20 while the central axis and circumferential positioning are adjusted.

Supporting member 20 on which exposure units 12 for each color are positioned and mounted is inserted inside cylindrical photoreceptor drum 10. The front flange 111 is engaged on supporting shaft 122 wherein bearing 141 is pressed into acceptor lila. The rear flange 112 is engaged on supporting shaft 123 wherein bearing 142 is pressed into acceptor **112*a*. From both ends, E-rings 143 and 144 for preventing drawing are mounted on supporting shafts 122 and 123. By means of front flange 111 and rear flange 112, photoreceptor drum 10 is interposed. In addition, from both ends of supporting member 20, flat faces 122*a* and 123*a* at the edge of supporting shaft 122 and 123 are inserted into elongated holes 106e and 107*e* (not illustrated) through gap retention members 106 and 107 (not illustrated) on which the elongated holes 106*e* and 107*e* are provided. Thus, photoreceptor drum unit 10*a*** is formed.

In the above-mentioned state, due to flat faces **122*a* and 123*a* on the both ends of supporting member 20 and the elongated holes 106*e* and 107*e* (not illustrated) which are mounted on gap retention members 106 and 107, contact portions of an image forming means of gap retention members 106 and 107 to photoreceptor drum 10, i.e., convex portions 107*a* and 106*a* (not illustrated) as a contact portion of M developing device 13, convex portions 107*b* and 106*b* (not illustrated) as a contact portion of C developing device 13, convex portions 107*c* and 106*c* (not illustrated) as a contact portion of C scorotron charger 11 and convex portions 107*d* and 106*d* (not illustrated) as a contact portion of transfer device 14*a* are aligned with the central axis of photoreceptor drum 10 to be fixed. In addition, in order to contact between exposure unit 12** for each color and an image forming means provided on gap retention members 106 and 107, the contact portions of each means are aligned on the circumference of the image forming body.

Photoreceptor drum unit 10*a* is put into frame 101 while flat faces 122*a* and 123*a* on photoreceptor drum unit 10*a* pass long grooves 102*a* and 103*a*. From both ends, fixing rings 151 and 152 are caused to insert in holes 102*b* and 103*b* on front and rear side plates 102 and 103. Elongated holes 151*a* and 152*a* are caused to engage with flat faces 122*a* and 123*a* provided at the end of supporting shafts 122 and 123. Respective three holes 151*b* and 152*b* on fixing rings 151 and 152 are caused to align with screw holes 102*c* and 103*c* (not illustrated) on front and rear side plate 102 and 103. Screws 155 and 156, from both ends are screwed to fix photoreceptor drum unit 10*a*. Gear 10G for driving the photoreceptor drum provided on rear flange 112 of photoreceptor drum 10 is engaged with gear G1 provided on process unit 100.

In the above-mentioned state, due to flat faces 122*a* and 123*a* on the both ends of supporting member 20 of photoreceptor drum unit 10*a* and elongated holes 151*a* and 152*a* which are mounted on fixing rings 151 and 152 on both ends, contact portions of an image forming means of gap retention members 106 and 107 in process unit 100, i.e., convex portions 107a and 106*a* (not illustrated) as a contact portion of M developing device 13, convex portions 107*b* and 106*b* (not illustrated) as a contact portion of C developing device 13, convex portions 107*c* and 106*c* (not illustrated) as a contact portion of C scorotron charger 11 and convex portions 107*d* and 106*d* (not illustrated) as a contact portion of transfer device 14*a* are aligned with process unit 100 so that photoreceptor drum unit 10*a* is fixed. In addition, in order to contact between exposure unit 12 for each color and an image forming means provided on gap retention members 106 and 107, the contact portions of each means are aligned on the circumference of the image forming body, and then the photoreceptor drum unit 10*a* is fixed.

Cleaning device 19 is inserted in frame 101. While both ends of cleaning device 19 are pushed to contact portions of gap retention members 106 and 107, cleaning device 19 is fixed to frame 101 by screws (not illustrated). In addition, scorotron charger 11 is inserted in frame 101. While corona charging electrode retention portions 11*b* on both ends of scorotron charger 11 are pushed to the contact portions of gap retention members 106 and 107, scorotron charger 11 is fixed to frame 101 by screws (not illustrated). Developing device 13 is inserted in frame 101. While both ends of development casing 138 of developing device 13 are pushed to the contact portions of gap retention member 106 and 107, developing device 13 is fixed to frame 101 by screws (not illustrated). Further, replenishing tanks for each color 21 are mounted on frame 101 so that process unit 100 is formed. Against the image forming body, the gap between each image forming means and the image forming body and circumferential position of each image forming means are positioned at high accuracy and are fixed.

Specifically, in the present invention, by making a supporting member which supports an exposure means in a static statue as the benchmark, positioning with higher accuracy has been realized. If the drum shaft, which rotates together with a photoreceptor drum, is caused to be the benchmark as in the case of exposing from the outside of the photoreceptor drum, there is a possibility that vibration due to the drum shaft when rotating influences on the process means including the developing device, resulting in fluctuation in the distance between the process means and the photoreceptor. On the contrary, in the present invention, since the benchmark is the optical system supporting section which are kept in static status, the above-mentioned vibration cannot occur. Accordingly, each process means can always maintain accurate positional relationship with the drum.

In addition, the process means such as the developing devices do not directly press the photoreceptor drum. Accordingly, the deformation does not occur. Due to this, thickness of the drum can further be reduced. Therefore, light decay from the optical system inside the drum when transmitting the photoreceptor drum can be prevented. In addition, aforesaid optical system can be closer to the external surface of the drum. Accordingly, the optical system can be driven with less power. Therefore, light can be focused on the external surface of the photoreceptor drum with high accuracy, and rise of temperature inside the drum and heat swelling following it can be prevented.

Process unit 100 is loaded on the color image forming apparatus, by inserting guide rails R1 and R2 provided on both ends of process unit 100 into two guide members T1 and T2 provided on the color image forming apparatus. Then, gear 10G, for driving the photoreceptor drum, provided on rear flange 112 of photoreceptor drum 10 is engaged with a gear provided on the apparatus main body (not illustrated) through gears G1 and G2 provided on process unit 100 so the photoreceptor drum 10 is driven while keeping positional relationship at high accuracy with scorotron chargers 11, developing devices 13, cleaning device 19 and transfer device 14*a*, which are used as image forming means, which are positioned by exposure unit 12 and gap retention members 106 and 107. When process unit 100 is detached from or attached to the apparatus main body, transfer device 14*a*, neutralizer 14*b* and transfer belt 14*e*, which are brought into contact with the contact portion of gap retention members 106 and 107 to be positioned, are separated from photoreceptor drum 10.

The constitution of the present invention explained referring to the above-mentioned embodiment is not necessarily be limited to a process unit. For example, it may be used in a case when the photoreceptor drum unit is mounted, in which the gap retention member is provided, on the side plate of the apparatus main body of a color image forming apparatus. The gap retention member is not necessary to be a disc-shaped. In addition, the contact portion of the gap retention member may be formed by a concave one, not necessarily be convex one. The dimensions of the contact portion may be smaller than the diameter of the drum.

Owing to the present invention, the gap between the image forming means and the image forming body can be maintained with extremely high accuracy while the image forming body is not directly be pressed by the image forming means, and thereby the image forming body is neither deformed nor damaged when maintaining the gap between the image forming means and the image forming body. Due to the structure, extremely favorable images can be formed.

In addition, chargers are positioned against the image forming body so that the image forming body is uniformly charged.

In addition, while there is no imbalance pressure on the image forming body by plural developing device, thereby the developing devices are positioned with high accuracy so that favorable development on the image forming body is conducted.

In addition, while there is no imbalance pressure on the image forming body by plural developing devices, the transfer device is positioned with high accuracy so that superposed toner images are favorably transferred.

In addition, the image forming body is not pressed imbalancely by the cleaning device, and aforesaid cleaning device is positioned with high accuracy.

What is claimed is:

1. An image forming apparatus comprising:

(a) a rotary image forming body;

(b) a plurality of chargers provided around the image forming body for charging the image forming body;

(c) a plurality of imagewise exposure means for imagewise exposing the charged image forming body to form respective latent images thereon;

(d) a plurality of developing devices for developing the respective latent images formed on the image forming body to form respective toner images, wherein a plurality of different color toner images formed by the respective chargers, the respective imagewise exposure means and the respective developing devices are superimposed on the image forming body, thereby a color toner image is formed;

(e) transfer means for transferring the color toner image on the image forming body onto a transfer member;

(f) cleaning means for removing a residual toner on the image forming body;

(g) a support member for supporting the plurality of exposure means, wherein the support member and plurality of exposure means supported on the support member are provided inside the image forming body which is kept in a static status; and (h) a gap keeping member for holding the plurality of chargers, the plurality of developing devices, the transfer means or the cleaning means with reference to the support member so as to keep a gap with the image forming body constant.

2. The image forming apparatus of claim 1, wherein the gap keeping member is provided coaxially with the support member.

3. The image forming apparatus of claim 1, wherein the support member is provided coaxially with the image forming body.

4. The image forming apparatus of claim 1, wherein the gap keeping member, the support member and the image forming body are coaxially provided with each other.

* * * * *